United States Patent [19]

Delestre et al.

[11] Patent Number: 4,620,168

[45] Date of Patent: Oct. 28, 1986

[54] COAXIAL TYPE TUNABLE HYPERFREQUENCY ELIMINATION BAND FILTER COMPRISING OF DIELECTRIC RESONATORS

[75] Inventors: Xavier Delestre, Paris; Marc Sauvage, La Garenne-Colombes, both of France

[73] Assignee: Thomson CSF, Paris, France

[21] Appl. No.: 608,573

[22] Filed: May 9, 1984

[30] Foreign Application Priority Data

May 20, 1983 [FR] France ..... 83 08423

[51] Int. Cl.[4] ..... H01P 1/20

[52] U.S. Cl. ..... 333/202; 333/219; 333/235; 333/207

[58] Field of Search ..... 333/202, 219, 235, 222, 333/223–226, 206, 207

[56] References Cited

U.S. PATENT DOCUMENTS

| | | | |
|---|---|---|---|
| 2,764,743 | 9/1956 | Robertson | 333/251 |
| 4,184,130 | 1/1980 | Nishikawa et al. | 333/206 |
| 4,459,570 | 7/1984 | Delaballe et al. | 333/235 X |

FOREIGN PATENT DOCUMENTS

| | | |
|---|---|---|
| 0047203 | 3/1982 | European Pat. Off. . |
| 1416135 | 9/1965 | France . |

*Primary Examiner*—Eugene R. LaRoche
*Assistant Examiner*—Benny Lu
*Attorney, Agent, or Firm*—Cushman, Darby & Cushman

[57] ABSTRACT

A tunable hyperfrequency elimination band filter forms a coaxial line having a rectangular cross-section external conductor enclosing a rectangular cross-section internal conductor which is substantially co-axial therewith. A plurality of cylindrical resonators are mounted on an interior face of the external conductor. The width of the internal conductor is reduced in areas adjacent to each resonator. The resonators are cylindrically shaped and constructed of a dielectric material. Each resonator is mounted to the interior face by means of dielectric screws which may be adjusted to cause the central frequency of the filter to be tuned. Hyperfrequency absorbent material may be placed on the interior walls in areas opposite the resonators.

14 Claims, 4 Drawing Figures

COAXIAL TYPE TUNABLE HYPERFREQUENCY ELIMINATION BAND FILTER COMPRISING OF DIELECTRIC RESONATORS

BACKGROUND OF THE INVENTION

1. Field of the Invention

The present invention concerns the field of hyperfrequency filters. Radiowave systems of large and average capacity often include hyperfrequency elimination band filters, the purpose of which is to eliminate fixed frequency disturbances. These filters can be realized by utilizing various technologies: wave guide, microstrip, coaxial line, etc.

For Radiowave systems, it is generally necessary that the filters are perfectly adapted in the pass band, i.e. that their return rate of the stationary wave (R.S.W.) is lower than 1.2, and at the same time that their overvoltage coefficient is high. Indeed, the insertion losses due to the filters must vary only slightly in the transmission band, particularly close to the rejected band. Furthermore, it is also preferable to be able to shift, in a substantial manner, the tuning frequency of the filter. Indeed, a standard filter could be designed for several channels of the hyperfrequency band, this same filter being able to be centered on one or another of these channels according to demand.

2. Description of the Prior Art

The hyperfrequency elimination band filters currently utilized do not allow one to obtain simultaneously these various characteristics, other than filters with cavities coupled to a wave guide. But these filters with cavities coupled to a waveguide have a complicated structure and relatively large dimensions.

The recent utilization of dielectric resonators placed in a coaxial structure has permitted the realization of elimination band filters having improved performance and requiring less space. But, for reasons that will be explained hereinbelow, the real tuning range of the resonators in a structure of this type is considerably reduced, lower than 10 MHz, due to the appearance of disturbing resonances in the transmitted band.

SUMMARY OF THE INVENTION

The present invention concerns a hyperfrequency elimination band filter, of the coaxial type, having dielectric resonators, tunable in a frequency band greater than or equal to 50 MHz.

According to the invention, a tunable hyperfrequency elimination band filter, comprises a box with a rectangular section forming the external conductor of a coaxial line, an internal condutor, and an assembly of cylindrical dielectric resonators placed inside the box and fixed through intermediary supports onto a face of the external conductor box, wherein the internal conductor has substantially the same form and the same longitudinal axis as the external conductor and the resonators have their axes parallel to the small side of the external conductor and are situated adjacent to the internal conductor, wherein the internal conductor has a reduced width adjacent to the resonators, and wherein the supports of the resonators are screws made of dielectric material, the central frequency of the filter being adjustable by variable screwing-in or screwing-out the screw-resonators.

BRIEF DESCRIPTION OF THE DRAWINGS

The invention will be better understood and other characteristics will be become apparent from reading through the following description given with reference to the annexed drawings in which.

DESCRIPTION OF THE PREFERRED EMBODIMENTS

Figure 1:
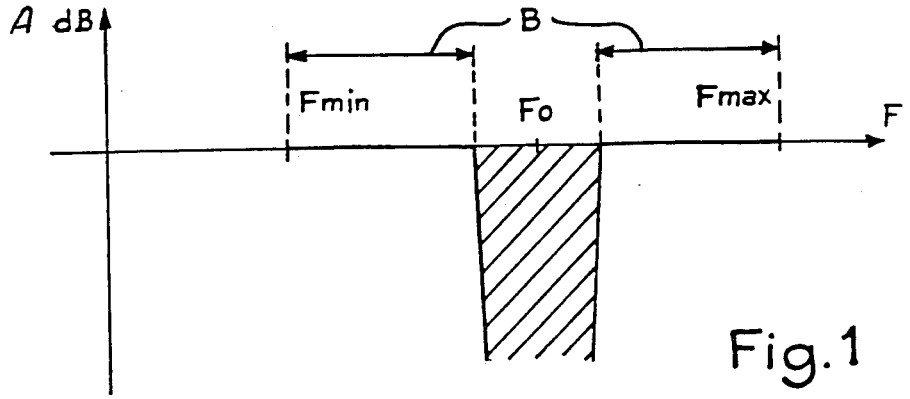
FIG. 1 is the transfer function of an elimination band filter, as a function of the frequency.

FIG. 1 represents the attenuation characteristic A (in dB) as a function of the frequency for an elimination band filter centered on the frequency $F_0$, the width of the rejected band being B, and the pass-band of the filter extending on either side of the rejected band to $F_{min}$ at the lower frequencies and to $F_{max}$ at the higher frequencies.

In the known coaxial type elimination band filters having dielectric resonators, the resonators have a cylindrical shape and are wholly constructed with dielectric material. In order to realize the required filtering function, the resonators are placed on insulating supports, adjacent to the internal conductor of a coaxial line formed by this conductor and an external conductor forming the box. For a given system, the geometrical dimensions of a resonator are determined in order to obtain a resonance in mode $TE_{01\Delta}$. The frequency of this mode at resonance is lower than the central frequency $F_0$ of the filter to be realized. In order to tune this filter to the frequency $F_0$, a metallic screw having the same axis as the dielectric resonator and integral with the box is brought closer to the resonator.

The overvoltage coefficient of the resonators placed in such a structure depends on the distance separating the walls from the external conductor. Indeed, too small a distance increases the losses by the Joule effect on these walls. Furthermore, due to its geometric dimensions and its shape, the external conductor constitutes a segment of a wave guide the ends of which are short-circuited. Propagation occurs in this wave guide along an axis perpendicular to that of the coaxial line. The resonant cavity thus created makes the coaxial line unsuitable for certain frequencies close to the pass-band or even situated in the pass-band. The first disturbing resonance encountered in the direction of the increasing frequencies is a function of the total width l of the external conductor. The second resonance corresponds to the distance separating the internal conductor from the furthest removed wall of the external conductor. Other resonances appear at high frequencies but they are very distant from the pass-band. The screwing-in of the metallic screws that allow the adjustment of the frequency of the resonators also acts on the frequency of these disturbing resonances, as in a classical cavity. Due to this fact, and as indicated hereinabove, the real tuning range in a structure of this type is very reduced, lower than 10 MHz.

The hyperfrequency filter tunable in a wide band according to the invention, prevents disturbing resonances in a pass-band; it thus permits the filter to be tuned over a clearly higher tuning range, at least equal to 50 MHz.

Figure 2:
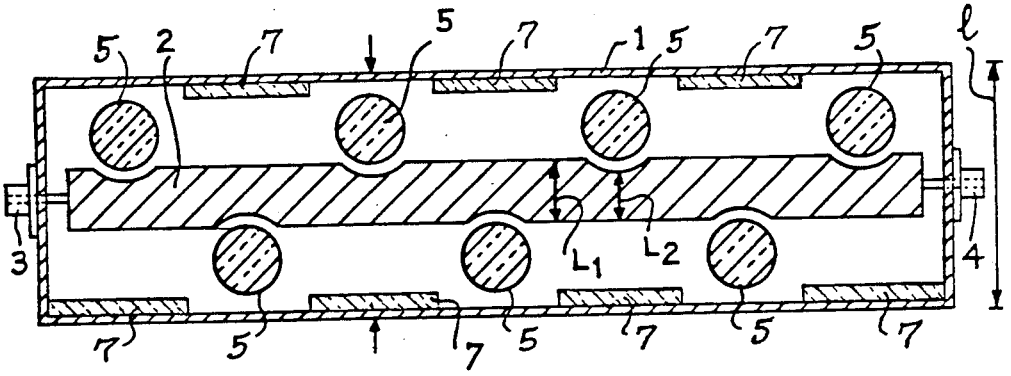
FIG. 2 is a longitudinal section in the horizontal plane of an embodiment of the filter according to the invention.
Figure 3:
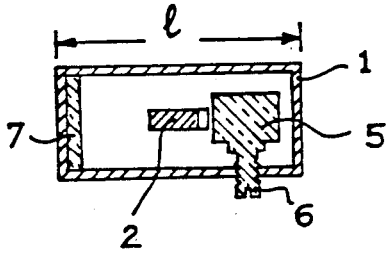
FIG. 3 is a cross-section of the filter represented in FIG. 1.

In FIGS. 2 and 3, which represent sections of an embodiment according to the invention, the coaxial type elimination filter comprises a metallic box forming the external conductor 1, an internal conductor 2, with a rectangular (or ellipsoidal) section, having approximately the same geometric axis as the external conductor 1. The internal and external conductors have their large and small axes respectively parallel. Accesses 3 and 4 comprise the input and the output of the filter, between the two conductors 1 and 2. The filter comprises, furthermore, a certain number of cylindrical dielectric resonators, such as 5, that modify the electric field transmitted by this coaxial line. These resonators have their axes parallel to the small dimension of the external conductor. These resonators are placed adjacent to the internal conductor 2 of the coaxial line. The width $L_1$ of the internal conductor is reduced to $L_2$ close to each dielectric resonator. The adjustment of the frequency of a resonator 5 is realized through its movement along its axis. To do this, the cylindrical dielectric resonator 5 is integral with a screw 6 (see FIG. 3) also made of dielectric material. The assembling of the resonator and the screw may be carried out by gluing: the resonator is glued onto the head of the screw, preferably in a slightly eccentric disposition.

Without any elements other than those described up to now, this elimination band filter allows a real tuning bandwidth of about 50 MHz, for a resonator the resonance frequency of which is located at 4 GHz. The internal frequency that separates the two lower disturbing resonances, is equal to 700 MHz.

But this elimination band filter can be further improved by placing on the internal walls of the external conductor, at wisely selected sites, a hyperfrequency absorbent material 7. This absorbent material 7 is placed on the lateral wall opposite to each dielectric resonator. In the embodiment represented in FIG. 2, where the dielectric resonators are placed on either side of the internal conductor, the hyperfrequency absorbent material 7 is placed alternately on either side of the internal conductor on the face opposite the resonator. This disposition is not limitative and all the resonators can be disposed on the same side of the internal conductor. In this case, the hyperfrequency absorbent material 7 is made of a single piece and covers the whole of the lateral wall opposite the resonators. The hyperfrequency filter provided with this absorbent material 7 allows the elimination of the first disturbing resonance function of the width l of the external conductor, and only slightly modifies the transmission losses of the coaxial line. The tuning bandwidth of such a filter, through corresponding resonators, for a central frequency $F_0$ of 4 GHz is about 150 MHz.

Figure 4:
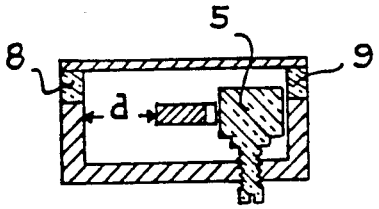
FIG. 4 is a cross-section of a second embodiment of the filter according to the invention.

FIG. 4 represents in cross-section a second embodiment of the hyperfrequency filter according to the invention. The longitudinal section, along a horizontal plane of this embodiment of the filter according to the invention, is analogous to the scheme represented in FIG. 2, from which has been removed the hyperfrequency absorbent material 7.

In this case, the hyperfrequency absorbent material is disposed in the lateral faces of the box itself, which is thus formed in cross-section (as shown in FIG. 4), from a U-shaped cross-section conductor box and a conducting cover separated from the U-shaped box by two hyperfrequency absorbent bands 8 and 9. The electrical continuity of the external conductor is ensured by the two end plates of the box. The hyperfrequency absorbent pieces 8 and 9 allow the elimination of the two lower disturbing resonances. However, these pieces reduce substantially the overvoltage coefficient of the resonator. The tuning bandwidth of this type of filter, for a central frequency $F_0$ of 4 GHz, is close to 200 MHz, and the first disturbing resonance encountered in the order of increasing frequencies is situated at 5.5 GHz.

Therefore, the filter according to the invention comprises an internal conductor having a rectangular or ellipsoidal section the width of which is reduced in the vicinity of the dielectric resonators, and the disturbing resonances of which can be suppressed by wisely placed hyperfrequency absobent material, allows a substantial increase in the tuning range of the resonator, while maintaining a simple structure. The overvoltage coefficient of this type of filter remains high, the losses through reflection are reduced due to the hyperfrequency absorbent material, and the coupling conditions between the resonators hardly vary.

We claim:

1. A tunable hyperfrequency elimination hand filter comprising:

rectangular box means for forming an external conductor of a coaxial line, said box means having a top, a bottom, two side walls, and a first longitudinal axis;

internal conductor means for forming an internal conductor of said coaxial line, said internal conductor means having a second longitudinal axis which is substantially parallel with said first longitudinal axis, and a width transverse to said second longitudinal axis and parallel to said bottom, said width being reduced at a plurality of predetermined areas along said second longitudinal axis; and a plurality of cylindrical dielectric resonators disposed so as to form a line of resonators on said bottom adjacent to the reduced width areas of said internal conductor means, each said resonator having a longitudinal axis which is perpendicular to said second longitudinal axis and parallel to said side walls, each said resonator including support means having a dielectric screw connected to said bottom for adjusting a distance between said resonator and said top when said screw is rotated to cause a central frequency of said filter to be tuned.

2. A tunable hyperfrequency elimination band filter comprising:

rectangular box means for forming an external conductor of a coaxial line, said rectangular box means having a top, a bottom, two side walls, and a first longitudinal axis;

internal conductor means for forming an internal conductor of said coaxial line, said internal conductor means being disposed inside said rectangular box means; and a resonator disposed inside said external conductor means and connected to said bottom, said resonator having a longitudinal axis which is perpendicular to said first longitudinal axis and parallel to said side walls, said resonator including support means adjustably connected to said bottom for adjusting said resonator along said resonator longitudinal axis to vary a distance between said resonator and said top to cause a central frequency of said filter to be tuned.

3. A filter according to claim 2 wherein said internal conductor means has second longitudinal axis which is substantially parallel with said first longitudinal axis.

4. A filter according to claim 3 further including a plurality of resonators adjustably connected to said bottom and disposed so as to form a first line of resonators parallel to said second longitudinal axis.

5. A filter according to claim 4 wherein said first line is adjacent to said internal conductor means, and wherein said internal conductor means has a width transverse to said second longitudinal axis and parallel to said bottom and which is reduced in width at areas adjacent said resonators.

6. Apparatus according to claim 5 wherein said resonators have a cylindrical shape and are constructed of dielectric material.

7. Apparatus according to claim 6 wherein said support means includes a screw made of dielectric material.

8. A filter according to claim 7 wherein said internal conductor means has a rectangular cross-section.

9. A filter according to claim 7 including a further plurality of resonators disposed on said bottom so as to form a second line of reasonators substantially parallel to said second longitudinal axis and on an opposite side of said internal conductor means from said first line.

10. A filter according to claim 9 further including a plurality of pieces of hyperfrequency absorbant material disposed inside said external conductor means on said side walls, each piece of said material being located on an opposite side of said internal conductor means from and associated with a respective one of said resonators.

11. A filter according to claim 9 wherein said side walls each include a hyperfrequency absorbant band disposed parallel to said first longitudinal axis so as to interrupt electrical contact between said side walls said top.

12. A filter according to claim 7 further including hyperfrequency absorbant material disposed inside of said external conductor means on a side wall which is on an opposite side of said internal conductor means from said resonators.

13. A filter according to claim 7 wherein a side wall on an opposite side of said internal conductor means from said resonators includes a hyperfrequency absorbant band disposed so as to interrupt electrical contact between said side wall and said top.

14. Apparatus according to claim 7 wherein each said resonator is mounted eccentrically with respect to said resonator longitudinal axis on said dielectric screw.

* * * * *